United States Patent [19]

Mirabel et al.

[11] 4,331,483

[45] May 25, 1982

[54] ION EXCHANGE PURIFICATION OF SUGAR BEET JUICE

[75] Inventors: Bernard Mirabel, Orly; Claude Rollin, Corbeil Essonne, both of France

[73] Assignee: Rhone-Poulenc Industries, Courbevoie, France

[21] Appl. No.: 207,905

[22] Filed: Nov. 18, 1980

[30] Foreign Application Priority Data

Nov. 29, 1979 [FR] France ..... 79 29360

[51] Int. Cl.[3] ..... C13D 3/14; C13D 3/02; C13D 3/18

[52] U.S. Cl. ..... 127/46.2; 127/54; 127/55; 521/28

[58] Field of Search ..... 127/46 A, 46 B; 521/28

[56] References Cited

U.S. PATENT DOCUMENTS

| | | | |
|---|---|---|---|
| 3,250,702 | 5/1966 | Levendusky | 210/24 |
| 3,961,981 | 6/1976 | Pollio et al. | 127/46 A |
| 3,966,489 | 6/1976 | Barrett | 127/46.1 |
| 3,969,261 | 7/1976 | Meiller | 521/28 X |
| 3,973,986 | 8/1976 | Schoenrock et al. | 127/46 A |
| 4,082,564 | 4/1978 | Fries | 127/46.1 |
| 4,100,149 | 7/1978 | Meiller et al. | 260/112 R |
| 4,140,541 | 2/1979 | Popper | 127/46.1 |
| 4,150,205 | 4/1979 | Wheaton | 521/28 |
| 4,238,243 | 12/1980 | Tu | 127/46.2 |
| 4,262,041 | 4/1981 | Eguchi | 521/28 X |

FOREIGN PATENT DOCUMENTS

| | | |
|---|---|---|
| 1113717 | 12/1955 | France . |
| 2093695 | 1/1972 | France . |
| 871541 | 6/1961 | United Kingdom . |

OTHER PUBLICATIONS

Abstract of Italian Appln. No. 46.876.

F. Schneider, Technologie des Zuckers [Sugar Technology], pp. 593–596, 632–635 (Verlag M. & H. Schaper Hannover, 1968), (translation enclosed).

*Primary Examiner*—Sidney Marantz

[57] ABSTRACT

Process for purifying beet juice by contacting the juice to be purified with at least two ion exchangers formed of a porous mineral support covered with a film of cross-linked polymer containing or bearing quaternary ammonium salt groups for at least one of the ion exchangers and sulfone groups for at least one of the other ion exchangers.

11 Claims, No Drawings

ION EXCHANGE PURIFICATION OF SUGAR BEET JUICE

BACKGROUND OF THE INVENTION

The present invention relates to a process of purifying beet juice by means of ion exchangers.

The conventional manufacture of sugar from sugar beets is effected by means of a series of operations which include cutting the washed beets into slices; treating the slices with preheated water which dissolves the sugar and water-soluble material; purifying the resultant sugar juices by preliming and liming, which eliminate, by precipitation, the organic and inorganic materials which interfere with subsequent crystallization, carbonation, and filtration; which produces juices containing sugars and salts from which the sucrose is separated by the steps of concentration, crystallization, and centrifuging, leaving a residue, namely, molasses. However, this relatively lengthy process consumes substantial amounts of energy and gives, prior to the crystallization step, a sugar syrup which still contains impurities which, after the crystallization step, are present in the molasses into which they entrain a substantial part of the desired sucrose, thus decreasing the yields of sucrose.

It is known to treat sugar beet juices by means of ion-exchange resins after flocculation with alcohol in order to separate the different components for purposes of analysis. However, while these techniques make it possible to establish the composition of the juices, they are not helpful in producing crystallizable sugar syrups on an industrial scale.

The process of the invention makes it possible to avoid the conventional steps of liming, carbonation, and filtration and also makes it possible, by eliminating all the organic nitrogen materials, to obtain from the sugar beet juices a purified sugar syrup having a good yield of sucrose, by means of only a single operation, which consumes very little energy.

The foregoing, therefore, describes several among the important objects of the invention.

It is a further object of the present invention to provide a novel process for the purification of sugar beet juices, employing ion exchangers.

GENERAL DESCRIPTION OF THE INVENTION

The process of the present invention comprises treating sugar beet juices by means of ion exchangers, and after filtration of the juices to be purified, they are contacted with at least two ion exchangers having an exchange capacity less than about 2 meq/g. (milliequivalents per gram), comprising a porous mineral support having a particle size of from about 50 $\mu$m to 5 mm., a specific surface of from about 5 to 600 $m^2/g$. (square meters per gram), a pore diameter of from about 60 to 2000 Å, and a pore volume of from about 0.4 to 2 ml/g. (milliliters per gram), covered by an amount of less than about 15 $mg/m^2$ (milligrams per square meter) of a film of cross-linked polymer containing or bearing quaternary ammonium salt groups for at least one of the ion exchangers, and sulfone (sulfonic) groups for at least one of the other exchangers.

The mineral supports serving as a base for the ion exchangers are represented by aluminas and silicas. The supports of the plurality of ion exchangers used may be of the same nature or of a different nature and may have the same characteristics or different characteristics, provided that they remain within the characteristics indicated above.

The quaternary ammonium salt groups are represented by the formula $—N^{(+)}—(R)_3X^{(-)}$ in which R, which may be identical or different, represents an alkyl or hydroxyalkyl group having from about 1 to 4 carbon atoms, and X represents an inorganic or organic anion, such as, for instance, chloride, sulfate, nitrate, phosphate, or citrate anions.

The quaternary ammonium salt and sulfone groups are part of the chain of the cross-linked polymer or are attached to the cross-linked polymer which covers the surface of the support.

The cross-linked polymers which cover the surface of the support are known products obtained from monomers, such as epoxy compounds which cross-link with the polyamines as catalysts; formaldehyde, which cross-links by polycondensation with urea, melamine, polyamines, or phenols; the vinyl monomers: vinyl pyridine, styrene, and derivatives which cross-link with polyfunctional monomers, such as the mono- or polyalkylene glycol diacrylates or dimethacrylates, divinylbenzene, vinyl trialkoxysilane, vinyl trihalosilane, and bismethylene acrylamide, in the presence of an initiator or of ultra-violet rays.

The covering of the mineral support by the cross-linked polymer is obtained by impregnating the support with a solution of the monomer or monomers, and optionally an initiator, in a solvent which is then evaporated, and the resulting monomers cross-link in accordance with the known cross-linking or polymerization processes. As solvent, there may be employed any solvents for the monomers and the initiator, whose boiling point is preferably as low as possible in order to favor ease in its subsequent evaporation. These are, preferably, for instance, methylene chloride, ethyl ether, benzene, acetone, and ethyl acetate.

In the event that the cross-linked polymer on the surface of the support does not have functional groups in its chain, it is necessary to modify the polymer. This is true in particular of the cross-linked polymers having a base of styrene and derivatives, polymers of formaldehyde with urea, melamine, polyamines, and phenols. This modification, in the case of polymers of formaldehyde with polyamines, urea, and melamine consists in transforming the primary amines present in the chain into quaternary ammonium salts in accordance with any conventional technique, for instance, by reaction with an alkyl sulfate or an alkyl halide. This modification, in the case of phenol formaldehyde resins or polymers of styrene, consists in fixing onto the polymer either sulfone groups by any known process or chloromethyl groups which are then reacted with a tertiary amine to produce quaternary ammonium groups, which reaction is carried out in accordance with any known technique.

In order to fix the chloromethyl groups on the polymer, it is advantageous, in the case of a phenol formaldehyde resin, for instance, to disperse the mineral support covered by the polymer in epichlorhydrin and permit reaction at an elevated temperature. On the other hand, in the case of the polymers of styrene, the mineral support covered with the polymer can be dispersed in chloromethyl ether at an elevated temperature in the presence of a Lewis acid. This modification, in the case of polymers of derivatives of styrene having an alkyl group of from about 1 to 3 carbon atoms on the ring, consists in effecting a bromination by means of an N-bromoamide or N-bromoimide and then reacting with a tertiary amine. Such a process is described in commonly assigned U.S. patent application, Ser. No. 178,893, filed on Aug. 18, 1980, entitled "Preparation of Anion Exchange Resins by Bromination of Vinyl Aromatic Polymers," by Adrien Dromard and R. Ramanadin.

The juices to be purified are obtained in the conventional manner by extracting sugar beet slices with hot water at a temperature, preferably, of about 70° to 80° C., followed by filtration of the juices. Possible preliming may facilitate the filtration.

The contacting of the beet juices with the ion exchangers is effected in succession with each of the ion exchangers, in any order whatsoever, at a temperature of not more than about 85° C., and at an acid, neutral or basic pH, selected as a function of each of the ion exchangers and of the impurity or impurities to be removed and retained by the ion exchangers. The amounts of each of the ion exchangers, which may be the same or different, are less than or equal to 800 g/l (grams per liter) of beet juice.

After purification, the juices obtained contain practically no organic nitrogen impurities. The juices consist of a solution of sugars and of inorganic salts. This solution may either be concentrated in order to form a sugar syrup, which is then subjected to an operation for crystallization of the sucrose, or demineralized by ion exchange or electrodialysis by any known process and then concentrated to give a sucrose syrup which can be used as is or be submitted to a sucrose crystallization operation. In accordance with the process of the invention, the residue of the crystallization operation is no longer molasses, but a solution of difficultly crystallizable sugars, such as glucose and levulose.

Upon contact of the beet juice with the ion exchangers, the exchanger or exchangers having sulfonic groups retain the protein and non-protein nitrogen materials of cationic character, such as proteins, amino acids, and betaine, the vitamins, and the coloring substances, and the exchanger or exchangers having quaternary ammonium salt groups retain the pectins, the organic acids, and the nitrogen materials of anionic character. The use of two ion exchangers makes it possible to retain mixtures of these products while the use of more than two ion exchangers permits a more selective separation of the products.

The removal of the impurities retained by the ion exchangers is effected by elution with a solution of high ionic force, and preferably by means of a solution of basic pH for the exchanger with sulfone groups and a solution of acid pH for the exchanger with quaternary ammonium salt groups. The solution of high ionic force is a solution of inorganic or organic salts, such as sodium chloride, potassium chloride, ammonium carbonate, and ammonium acetate; the solution of basic pH is a solution of alkaline hydroxides, such as ammonia, sodium hydroxide, or potassium hydroxide, and the solution of acid pH is a solution of inorganic or organic acids, such as, for instance, hydrochloric acid, acetic acid, nitric acid, sulfuric acid, lactic acid, or carbonic acid.

The elution releases the products removed from the juices and fixed on the ion exchangers and permits the reuse of the exchangers. The products in mixture which are contained in the elution solutions can be separated from each other in the form of enriched fractions by treatment of the said solutions with adsorbents or ion exchangers having identical or different functional groups and characteristics of mineral supports, in particular, different pore diameters and/or silicas of the same characteristics, without functional groups.

The treatment of the sugar beet juices by the ion exchangers can be effected with identical results batchwise, semi-continuously in columns, or continuously with series of columns; this latter possibility being particularly well adapted to industrial operations.

The process of the invention is employed in the sugar industries for the extraction of the beet sugar and the obtaining of enriched fractions of the nitrogen materials.

SPECIFIC DESCRIPTION OF THE INVENTION

In order to disclose more clearly the nature of the present invention, the following examples illustrating the invention are given. It should be understood, however, that this is done solely by way of example and is intended neither to delineate the scope of the invention nor limit the ambit of the appended claims. In the examples which follow, and throughout the specification, the quantities of material are expressed in terms of parts by weight, unless otherwise specified.

EXAMPLE 1

A. Preparation of a Cation Exchanger

On 200 g. of a silica having a particle size of 100 to 300 μm, a specific surface of 360 $m^2$/g., an average pore diameter of 90 Å, and a pore volume of 1.02 ml/g., there were polymerized 100 g. of distilled styrene and 5 g. of divinylbenzene in the presence of 0.45 g. of azo-bis-isobutyronitrile, whereupon the product obtained was washed with xylene at the boiling point.

The resulting polymer-covered silica was then reacted with 265 g. of sulfuric chlorhydrin dissolved in chloroform. The exchanger obtained had sulfonic groups attached and had the following characteristics:

| | |
|---|---|
| carbon content | 22.10% by weight |
| sulfur content | 4.80% by weight |
| quantity of fixed polymer | 1.40 mg/$m^2$ |
| exchange capacity | 1.40 meq/g. |

B. Preparation of an Anion Exchanger

The same polymer-covered silica produced above in Part "A" was reacted with 700 g. of chloromethylether containing 20 g. of stannic chloride and then with 150 g. of trimethylamine in a 30 percent by weight aqueous solution. The resulting anion exchanger obtained had appended $—N^{(+)}—(CH_3)_3Cl^{(-)}$ groups and had the following characteristics:

| | |
|---|---|
| carbon content | 23.20% by weight |
| chlorine content | 2.60% by weight |
| nitrogen content | 1.90% by weight |
| amount of fixed polymer | 1.40 mg/$m^2$ |
| exchange capacity | 1.35 meq/g. |

C. Preparation of Sugar Beet Juice

Sugar beets were first washed, then cut into slices. 100 g. of slices were soaked in 200 ml. of water and heated at 70° C. for one hour. The thus extracted slices were removed from the water and replaced by 100 g. of slices which had not yet been treated, and the water then heated at 70° C. for 30 minutes. The second group of slices was then removed from the water and the juice obtained was cooled and filtered.

D. Purification of Beet Juices 100 g. of cation exchanger "A" were introduced into a column of 25 mm. diameter (1); 300 ml. of N-hydrochloric acid were passed through the column, followed by distilled water until neutral. 50 g. of anion exchanger "B" were introduced into another column of 25 mm. diameter (2); 150 ml. of 1/10 N soda were passed through the column followed by distilled water until neutral.

150 ml. of the beet juice obtained in part "C," above, were then percolated into column (1) and then column (2) at room temperature, at a rate of flow of 100 ml/hour. The two columns were then washed with 100 ml. of distilled water.

The characteristics of the juice, color, pH, dried extract, amount of nitrogen in the dried extract, and action of lime at a pH of 11.2 were determined before treatment, at the outlet from column (1) and at the outlet from column (2). The results are summarized in Table 1, below.

TABLE 1

| | Raw Juice | Juice from 1st column | Juice from 2nd column |
|---|---|---|---|
| Color | black | very pale yellow | colorless |
| pH | 6 | 2 | 8.7 |
| Dry extract % by weight | 17.2 | 14.2 | 12 |
| Nitrogen content % by weight | 0.64 | 0.067 | <0.01 |
| Action of lime | abundant black precipitate | slight white precipitate | no precipitate |

The juice emerging from column (2) was concentrated under vacuum at 80° C. to a concentration of 80 percent solids by weight. A seed of 1 ml. of an 80 percent solution of crystalline sugar was then added. After cooling for 6 hours, the resulting crystallized sucrose was removed by centrifuging. The residual solution contained glucose, levulose, and the rest of the soluble sucrose which could then be crystallized by a further concentration, followed by crystallization.

The impurities retained in column (1) were eluted by passage of 400 ml. of a 1/10 N ammonia solution and the impurities retained in column (2) were eluted by passage of 260 ml. of a 1 N hydrochloric acid solution. The columns were available for reuse.

EXAMPLE 2

A. Preparation of a Cation Exchanger

This was produced in the same manner as in part "A" of Example 1, above.

B. Preparation of an Anion Exchanger

On 200 g. of silica having a particle size of 100 to 300 μm, a specific surface of 450 $m^2$/g., an average pore diameter of 86 Å, and a pore volume of 1.01 ml/g., there were polymerized 72 g. of methyl styrene and 30 g. of vinyl triethoxysilane in the presence of 1 g. of azo-bis-isobutyronitrile catalyst, whereupon the resulting product was washed with xylene at the boiling point.

The resulting polymer-covered silica was then placed in suspension in 600 ml. of carbon tetrachloride in which 4 g. of benzoyl peroxide were dissolved. 67 g. of N-bromo-succinimide were then added and the suspension was maintained at room temperature in the darkness for 4 hours. After filtration and washing with acetone and water, the polymer-covered silica was added to 350 ml. of an aqueous trimethylamine solution of 12.5 percent by weight and maintained in suspension for 3 hours. After filtration of, the treated polymer-coated silica, it was next treated with 600 ml. of 1/10 N hydrochloric acid and then separated from the hydrochloric acid.

The exchanger obtained had $—N^{(+)}—(CH_3)_3Cl^{(-)}$ groups and had the following properties:

| | |
|---|---|
| carbon content | 17.00% by weight |
| chlorine content | 2.30% by weight |
| nitrogen content | 1.10% by weight |
| amount of polymer fixed | 0.60 mg/$m^2$ |
| exchange capacity | 0.78 meq/g. |

C. Sugar Beet Juice

Produced as in part "C" of Example 1, above.

D. Purification of Beet Juices

The cation and anion exchangers and the sugar beet juices were utilized to purify the sugar beet juices as in Example 1, above, and the results obtained are set forth in Table 2, below.

TABLE 2

| | Raw Juice | Juice from 1st column | Juice from 2nd column |
|---|---|---|---|
| Color | black | very pale yellow | colorless |
| pH | 6 | 2 | 8.5 |
| Dry extract % by weight | 17.2 | 14.2 | 12.1 |
| Content of nitrogen % by weight | 0.64 | 0.067 | <0.01 |
| Action of lime | abundant black precipitate | slight white precipitate | no precipitate |

The impurities retained in column (1) were eluted by passage of 400 ml. of a 1/10 N solution of ammonia and the impurities retained in column (2) by 200 ml. of a 1 N solution of hydrochloric acid. The columns were then ready to be reused.

EXAMPLE 3

A. Preparation of a Cation Exchanger

On 200 g. of a silica having a particle size of 100 to 300 μm, a specific surface of 502 $m^2$/g., an average pore diameter of 80 Å, and a pore volume of 0.98 ml/g., there were polymerized 108 g. of distilled styrene and 37 g. of divinylbenzene in the presence of 1 g. of azo-bis-isobutyronitrile initiator, whereupon the product obtained was washed with xylene at the boiling point.

The resulting polymer-coated silica was then reacted with 176.5 g. of sulfuric chlorhydrin dissolved in chloroform. The exchanger obtained had sulfone groups appended to it and the following properties:

| | |
|---|---|
| carbon content | 11.20% by weight |
| sulfur content | 2.00% by weight |
| amount of polymer fixed | 0.40 mg/$m^2$ |
| exchange capacity | 0.60 meq/g. |

B. Preparation of an Anion Exchanger

Identical to that of part "B" of Example 2, above.

C. Sugar Beet Juices

Prepared as in part "C" of Example 1, above.

D. Purification of Beet Juices 25 g. of cation exchanger "A" were introduced into a column of 25 mm. diameter (1) and 300 ml. of N hydrochloric acid were passed into the column, followed by distilled water until neutral. 25 g. of anion exchanger "B" were introduced into a second column of 25 mm. diameter (2) and 100 ml. of 1/10 N sodium hydroxide were passed through the column, followed by distilled water until neutral. 70 ml. of the beet juices were percolated in column (1) and then in column (2) at 60° C., with a rate of flow of 100 ml/hour.

The characteristics of the juice, namely, color, pH, dried extract, content of nitrogen in the dried extract, and action of lime at a pH of 11.2 were determined before treatment, at the outlet of column (1) and at the outlet of column (2). The results are summarized in Table 3, below:

TABLE 3

| | Raw Juice | Juice from 1st column | Juice from 2nd column |
|---|---|---|---|
| Color | black | very pale gray | colorless |
| pH | 6 | 2 | 5.1 |
| Dry extract % by weight | 15.2 | 13.2 | 12.2 |
| Content of nitrogen % by weight | 0.73 | 0.10 | 0.04 |
| Action of lime | abundant black precipitate | slight white precipitate | no precipitate |

The impurities retained in column (1) were eluted by the passage of 150 ml. of a 1/10 N ammonia solution and the impurities retained in column (2) by 150 ml. of an N hydrochloric acid solution. The columns were then ready for reuse.

EXAMPLE 4

A. Preparation of a Cation Exchanger

On 100 g. of a silica having a particle size of 100 to 200 μm, a specific surface of 37 $m^2$/g., an average pore diameter of 1200 Å, and a pore volume of 0.95 ml/g., there were polymerized 55.5 g. of distilled styrene and 18 g. of vinyl triethoxysilane in the presence of 0.5 g. of azo-bis-isobutyronitrile initiator, whereupon the product obtained was washed with xylene at the boiling point.

The resulting polymer-covered silica was then reacted with 100 g. of sulfuric chlorhydrin dissolved in chloroform.

After filtration, washing and drying, the cation exchanger was obtained which had sulfone groups and the following properties:

| | |
|---|---|
| carbon content | 4.00% by weight |
| sulfur content | 1.40% by weight |
| amount of polymer fixed | 2.80 mg/$m^2$ |
| exchange capacity | 0.43 meq/g. |

B. Preparation of an Anion Exchanger

On 100 g. of a silica having a particle size of 100 to 200 μm, a specific surface of 37 $m^2$/g., an average pore diameter of 1200 Å, and a pore volume of 0.95 ml/g., there were polymerized 44.5 g. of vinyl toluene (60:40 mixture of para and meta isomers) and 13 g. of vinyltriethoxysilane in the presence of 0.5 g. of azo-bis-isobutyronitrile initiator, whereupon the product obtained was washed with ethyl acetate at the boiling point.

The resulting polymer-covered silica was then suspended in 400 ml. of carbon tetrachloride containing in suspension 20 g. of N-bromosuccinimide and 1.6 g. of benzoyl peroxide, whereupon the suspension was heated at the boiling point for 4 hours. After filtration and washing with acetone and water, the product obtained was suspended in 400 ml. of a 10 percent aqueous solution of trimethylamine and the suspension was maintained at room temperature for 4 hours. By filtration, washing with water and with acetone, and drying under vacuum at 50° C., there was obtained an anion exchanger which had $—N^{(+)}—(CH_3)_3Br^{(-)}$ groups and the following properties:

| | |
|---|---|
| carbon content | 9.30% by weight |
| bromine content | 3.20% by weight |
| nitrogen content | 0.54% by weight |
| quantity of polymer fixed | 4.40 mg/$m^2$ |
| exchange capacity | 0.39 meq/g. |

C. Preparation of Sugar Beet Juice 500 ml. of sugar beet juice, obtained in the same manner as in part "C" of Example 1, were prelimed by addition of 0.11 g. of quicklime. By filtration of the insoluble matter, a clarified juice was obtained.

D. Purification of Sugar Beet Juices 10 g. of cation exchanger "A" were introduced into a column of 10 mm. diameter (1); 50 ml. of N hydrochloric acid were passed through the column followed by distilled water until neutral. 50 g. of cation exchanger "A" were introduced into a second column of 25 mm. diameter (2); 200 ml. of N hydrochloric acid were passed through the column, followed by distilled water until neutral. 50 g. of anion exchanger "B" were introduced into a third column of 25 mm. diameter (3); 150 ml. of 1/10 N sodium hydroxide were passed through the column, followed by distilled water until neutral.

The clarified sugar beet juices, acidified to a pH of 2 by means of 1 N hydrochloric acid, were percolated at 4° C., into column (1) at a rate of 200 ml/hour. At the outlet of the column the juice was brought to a pH of 6 by means of 1 N sodium hydroxide solution and then percolated into column (2) and then column (3) at a rate of 200 ml/hour.

The columns were washed with 100 ml. of distilled water.

The characteristics of the juice, color, pH, dry extract, nitrogen content of the dried extract, and action of lime at a pH of 11.2, were determined before treatment, after preliming, and at the outlet from each of the three columns. The results are set forth in Table 4, below:

TABLE 4

| | Raw Juice | Juice after preliming | Juice from 1st column | Juice from 2nd column | Juice from 3rd column |
|---|---|---|---|---|---|
| Color | black | dark brown | pale yellow | colorless | colorless |
| pH | 6 | 2 | 1.9 | 5.5 | 7.5 |
| Dry extract % by weight | 15.2 | 15.2 | 14.4 | 13.8 | 13.4 |
| Content of nitrogen % by weight | 0.73 | 0.72 | 0.35 | 0.1 | <0.01 |
| Action of lime | abundant black precipitate | abundant dark brown precipitate | abundant white precipitate | slight white precipitate | no precipitate |

The impurities retained in column (1) were eluted by passage of 100 ml. of a 1/10 N ammonia solution. They consisted of coloring substances and a part of the proteins and amino acids.

The impurities retained in column (2) were eluted by passage of 350 ml. of a 1/10 N ammonia solution. They consisted of nitrogen materials and non-nitrogen materials of cationic character at a pH of 6.

The impurities retained in column (3) were eluted by passage of 300 ml. of a 1/10 N hydrochloric acid solution. They consisted of nitrogen materials or non-nitrogen materials of anionic character.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. A process of purifying sugar beet juices by means of ion exchangers, which process comprises contacting sugar beet juices with at least two ion exchangers having an exchange capacity of less than about 2 meq/g., formed of a porous mineral support having a particle size of about 50 $\mu$m to 5 mm., a specific surface of about 5 to 600 $m^2$/g., a pore diameter of about 60 to 2000 Å, and a pore volume of about 0.4 to 2 ml/g., covered with an amount of less than about 15 mg/$m^2$ of a film of cross-linked polymer having quaternary ammonium salt groups in the case of at least one of the ion exchangers and sulfonic groups in the case of at least one of the other ion exchangers.

2. A process according to claim 1, wherein said mineral support is a member selected from the class consisting of aluminas and silicas.

3. A process according to claim 1, wherein the said quaternary ammonium salt groups have the formula $-N^{(+)}-(R)_3X^{(-)}$ in which R represents a member selected from the class consisting of alkyl and hydroxyalkyl groups having from about 1 to 4 carbon atoms, and X represents an anion.

4. A process according to claim 1, wherein the cross-linked polymer covering the surface of the mineral support is produced from a monomer selected from the class consisting of epoxy compounds, formaldehyde, and vinyl monomers.

5. A process according to claim 1, wherein the sugar beet juices to be purified are obtained by extraction of beet slices by means of hot water, followed by filtration.

6. A process according to claim 5, wherein, before filtration, the juices are subjected to preliming.

7. A process according to claim 1, wherein the contacting of the beet juices with the ion exchangers is effected in succession with each of the exchangers, in any order whatsoever, at temperatures of not more than about 85° C.

8. A process according to claim 1, wherein the amounts of each of the ion exchangers employed are less than or equal to 800 g/l of beet juice.

9. A process according to claim 1 wherein the resulting purified sugar beet juices are concentrated and crystallized to obtain sucrose.

10. A process according to claim 1 wherein the resulting purified sugar beet juices are demineralized by ion exchange or by electrodialysis and then concentrated to obtain sugar syrup.

11. A process according to claim 1, wherein impurities retained by the ion exchangers are eluted in the form of fractions enriched in nitrogen-containing materials.

* * * * *